US005820461A

United States Patent [19]

Pernatozzi

[11] Patent Number: 5,820,461

[45] Date of Patent: Oct. 13, 1998

[54] GAME FOR A CASINO

[76] Inventor: Michael P. Pernatozzi, 2973 Peridot St., Las Vegas, Nev. 89121

[21] Appl. No.: 646,504

[22] Filed: May 8, 1996

[51] Int. Cl.[6] ..... A63F 9/22

[52] U.S. Cl. ..... 463/16; 463/11; 463/25; 273/138.2; 273/139; 273/244.2

[58] Field of Search ..... 463/1, 3, 16, 11, 463/25, 30, 31, 34, 36, 40; 273/237, 244, 244.1, 244.2, 274, 293, 298, 460, 461, 138.1, 138.2, 139; 364/410, 412

[56] References Cited

U.S. PATENT DOCUMENTS

| | | | |
|---|---|---|---|
| 4,210,335 | 7/1980 | Licciardi | 273/244 |
| 4,252,321 | 2/1981 | Hopwood | 273/247 |
| 4,672,541 | 6/1987 | Bromley | 463/3 |
| 5,415,412 | 5/1995 | McMahon | 273/244 |

*Primary Examiner*—Jessica Harrison
*Assistant Examiner*—Mark A. Sager
*Attorney, Agent, or Firm*—Quirk & Tratos

[57] ABSTRACT

A player manipulates a control of a video slot machine to cause video images of checks representative of first, second and third base wagers to appear within video images of first, second and third base indicia, respectively. After the wagers are made, a video image of a first base card is displayed face-up and the images of the checks are moved in accordance with a first base action schedule. After a first base action, an image of a second base card is displayed face-up and the images of the checks are moved in accordance with a second base action schedule. After a second base action, an image of a third base card is displayed face-up and the images of the checks are moved in accordance with a third base action schedule. After a third base action, the slot machine makes a payout to the player that is equal to an amount represented by a multiple of checks whose images have moved to within a home plate indicium.

18 Claims, 1 Drawing Sheet

GAME FOR A CASINO

BACKGROUND OF THE INVENTION

1. Field of Invention

This invention is in the field of games of chance and, more particularly, is a method and apparatus associated with a new game that is suitable for a casino.

2. Description of the Prior Art

Slot machine play accounts for substantial portion of profit from gaming at a casino and is therefore important to the casino. Not only is the slot machine play profitable, it does not present security problems inherent in table game play at the casino. Because of the importance of slot machine play, a casino manager constantly searches for a marketing strategy to widen their appeal, thereby giving the casino a competitive advantage in the gaming industry. The marketing strategy includes a search for new slot machine games.

Digital electronic and video technology have provided an era of opportunity for innovation in the creation of a slot machine game. Most often, the game is a version of a table game, such as Poker or Blackjack.

It is believed that when the game is an analog of a sport, such as baseball, the game is most likely to resonate with a slot machine player because events presented during the game are within the ambit of the player's experience. Heretofore, there has not been a slot machine game, suitable for a casino, that is an analog of baseball.

SUMMARY OF THE INVENTION

An object of the present invention is to provide a game that has wide appeal to players at a casino.

Another object of the present invention is to provide a game that gives a casino a competitive advantage in the gaming industry.

According to one aspect of the present invention, a playing surface carries indicia suggestive of first base, second base, third base and home plate of a baseball diamond.

According to another aspect of the present invention, a player makes a wager by causing a disposition of a representation thereof within the first base indicium. Thereafter, a first base card is displayed face-up upon the playing surface and an action related to the wager is taken in accordance with a first base action schedule. After the action in accordance with the first base action schedule, a second base card is displayed face-up upon the playing surface and an action related to the wager is taken in accordance with a second base action schedule. After the action in accordance with the second base action schedule, a third base card is displayed face-up upon the playing surface and an action related to the wager is taken in accordance with a third base action schedule. After the action in accordance with the third base action schedule, a payout is made to the player that is equal to a multiple of an amount represented as being within the home plate indicium.

The invention is a new game that is especially suitable for slot machine play but is easily adapted for table game play. The new game combines a sporting element of baseball with a suspense filled gaming action of poker. Moreover, a player need not have any special skill or knowledge to be successful at the new game.

Other objects, features, and advantages of the invention should be apparent from the following description of the preferred embodiment as illustrated in the accompanying drawing.

BRIEF DESCRIPTION OF THE DRAWING

The sole FIGURE herein is a view of an image of a group of indicia on a playing surface whereon a game is played in accordance with the preferred embodiment.

DESCRIPTION OF THE PREFERRED EMBODIMENT

Figure 1:
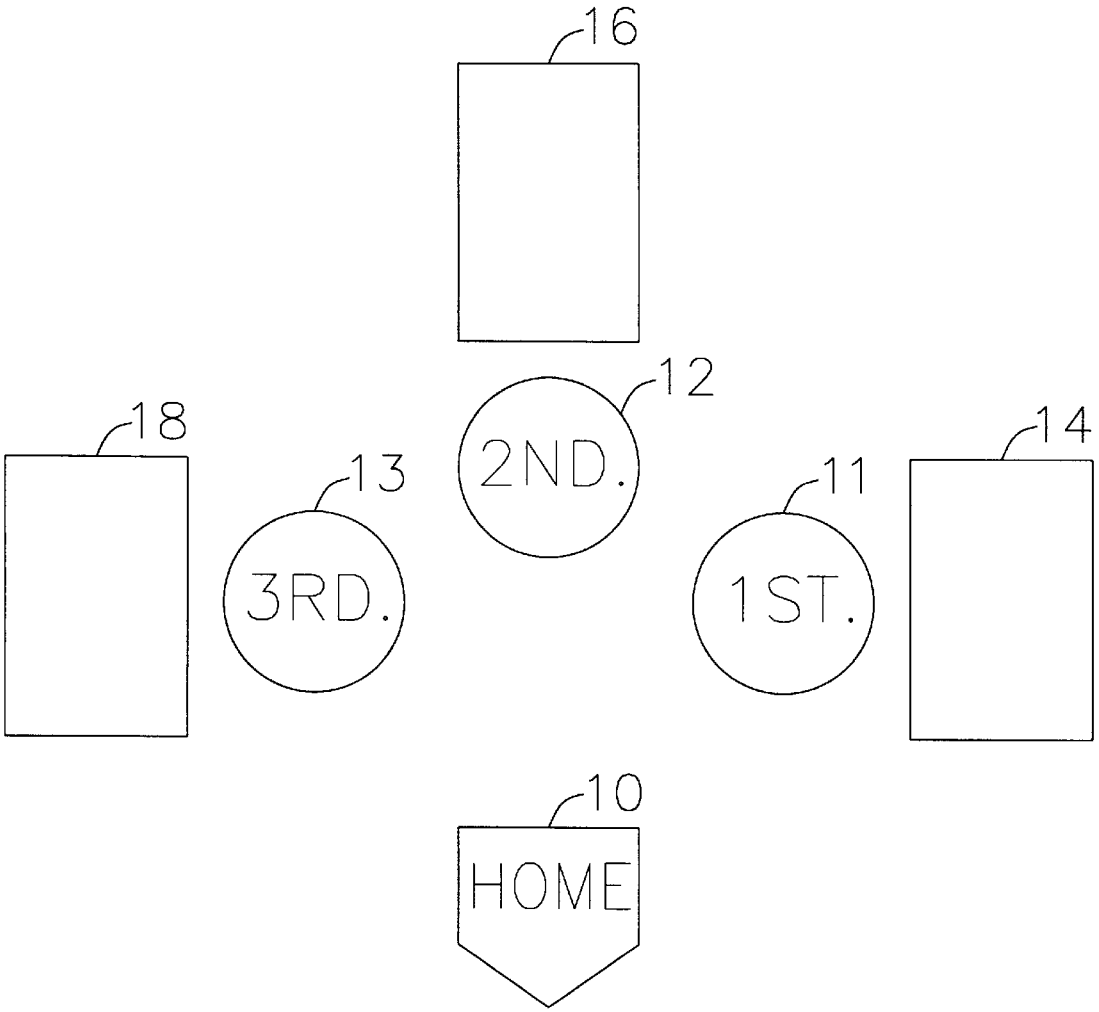

The present invention is a new game that is alternatively played by a player at a video slot machine or at a table by as many as five players.

As shown in the drawing, a slot machine provides a video image of a playing surface whereon a group of indicia includes a home plate indicium 10 in the well known pentagonal shape of the home plate of a baseball diamond. The group additionally includes a first base indicium 11, a second base indicium 12 and a third base indicium 13 that are circular. The indicia 10–13 are disposed to form a miniature baseball diamond.

Preferably, the group includes similar rectangular indicia 14, 16, 18. The indicia 14, 16, 18 are disposed adjacent to the indicia 11, 12, 13, respectively.

At the start of play of the game, a player makes a first base wager by manipulating controls of the machine to cause video images of wagering tokens (referred to hereinafter as checks) representative of the amount of the first base wager to appear within the indicium 11. Second and third base wagers are made in a similar manner. A manipulation of controls to change a video image is well known to those skilled in the electronics art.

The wagers are subject to a condition that the amount of the second base wager must be less than or equal to the amount of the first base wager and the amount of the third base wager must be less than or equal to the amount of the second base wager. The condition is necessary because by only making the third base wager, for example, a player acquires a statistical advantage in the wagering.

The machine stores digital signal representations of cards comprising six standard decks. After the wagers are made, the machine causes a random selection of a signal representation of what is referred to as a first base card. A video image of the first base card is displayed face-up within the indicium 14. When the first base card is displayed, the machine takes an action in accordance with a first base action schedule that is electronically stored within the machine. Electronic storage of a schedule is well known to those skilled in the electronics art.

The video images of the checks within the indicia 11, 12, 13 are moved in accordance with the first base action schedule which is given as:

FIRST BASE ACTION SCHEDULE

| FIRST BASE CARD | MACHINE ACTION |
|---|---|
| 10, Jack, Queen or a King | video images of checks are removed from the indicium 11 |
| Ace | video images of checks from the indicium 11 advance to the indicium 10 |
| 5, 6, 7, 8 or a 9 | video images of checks from the indicium11 advance to the indicium 12 |
| 4 of diamonds | video images of checks from the indicia 11, 12, 13 advance to the indicium 10 |

-continued

FIRST BASE ACTION SCHEDULE

| FIRST BASE CARD | MACHINE ACTION |
|---|---|
| 4 of spades, hearts or clubs | video images of checks are removed from the indicia 11, 12, 13 |
| 2 | video images of checks from the indicium 11 advance to the indicium 13 |
| 3 | video images of checks from the indicium 11 advance to the indicium 10 |

It should be appreciated that a machine action in accordance with the first base action schedule is analogous to an event that may occur during a baseball game. When the first base card is either a 10, Jack, Queen or a King, the action is analogous to a base runner being out at first base. When the first base card is either a 5, 6, 7, 8 or a 9 the action is analogous to the base runner advancing from first base to second base. When the first base card is a 4 of diamonds, the action is analogous to base runners advancing to home plate from first, second and third base. When the first base card is a 4 of either spades, hearts or clubs, the action is analogous to a triple play. When the first base card is a 2 or a 3, the dealer action is analogous to the base runner advancing from first base to third base and home plate, respectively.

After the action in accordance with the first action schedule, the machine causes a random selection of a digital signal representation of what is referred to as a second base card. A video image of the second base card is displayed face-up within the indicium 16. When the second base card is displayed, the machine takes an action in accordance with a second base action schedule that is electronically stored within the machine.

The video images of the checks within the indicia 12, 13 are moved in accordance with the second base action schedule which is given as:

SECOND BASE ACTION SCHEDULE

| SECOND BASE CARD | MACHINE ACTION |
|---|---|
| 10, Jack, Queen or a King | video images of checks are removed from the indicium 12 |
| Ace | video images of checks are advanced from the indicium 12 to the indicium 10 |
| 5, 6, 7, 8 or a 9 | video images of checks are advanced from the indicium 12 to the indicium 13 |
| 4 | video images of checks are removed from the indicia 12, 13 |
| 2, 3 | video images of checks are advanced from the indicium 12 to the indicium 10 |

Like the machine action taken in accordance with the first base action schedule, a machine action in accordance with the second base action schedule is analogous to an event that may occur during a baseball game. When the second base card is either a 10, Jack, Queen or a King, the action is analogous to a base runner being out at second base. When the second base card is either a 5, 6, 7, 8 or a 9 the action is analogous to the base runner advancing from second base to third base. When the second base card is a 4, the action is analogous to runners being out at second and third bases. When the second base card is a 2 or a 3, the action is analogous to the base runner advancing from second base to home plate.

After the action in accordance with the second base action schedule, the machine causes a random selection of a digital signal representation of what is referred to as a third base card. A video image of the third base card is displayed face-up within the indicium 18. When the third base card is displayed, the machine takes an action in accordance with a third base action schedule that is electronically stored within the machine.

The video images of the checks within the indicium 13 are moved in accordance with the third base action schedule which is given as:

THIRD BASE ACTION SCHEDULE

| THIRD BASE CARD | MACHINE ACTION |
|---|---|
| 4, 10, Jack, Queen or a King | video images of checks are removed from the indicium 13 |
| Ace, 2, 3, 5, 6, 7, 8, or 9 | video images of checks from the indicium 13 are advanced to the indicium 10 |

Like the machine actions taken in accordance with the first and the second base action schedules, a machine action taken in accordance with the third base action schedule is analogous to an event that may occur during a baseball game. When the third base card is either a 4, 10, Jack, Queen or a King, the action is analogous to a base runner being out at third base. When the third base card is either an Ace, 2, 3, 5, 6, 7, 8 or a 9 the action is analogous to the base runner advancing from third base to home base.

A payout schedule is electronically stored within the machine. After all of the actions have been taken as described hereinbefore, the machine makes a payout to the player that is a multiple of the number of checks displayed within the indicium 10. When an expected payout is greater than a known amount, the machine provides an indication of the expected payout to a casino employee who makes the payout.

The multiple is in accordance with the payout schedule which is given as:

PAYOUT SCHEDULE

| PAYOUT MULTIPLE | IMAGES OF CARDS WITHIN INDICIUM 14, 16, 18 |
|---|---|
| 3 | three card straight i.e. 3 of clubs, 4 of hearts and 5 of spades |
| 5 | three of a kind i.e. 5 of clubs, 5 of diamonds, 5 of spades |
| 10 | three card straight flush i.e. 3, 4 and 5 of clubs |
| 500 | three Aces of diamonds |
| | three 2's of diamonds |
| | three 3's of diamonds |
| | three 5's of diamonds |
| | three 6's of diamonds |
| | three 7's of diamonds |
| | three 8's of diamonds |
| 1000 | three 9's of diamonds |
| 1 | all other combinations of three cards |

The present invention may be alternatively embodied as a table game. In the table game embodiment, as many as five players are at five player stations, respectively, that are evenly spaced adjacent to an arcuate edge of a semicircular table that is approximately the size of a Blackjack table. The player stations are numbered consecutively from one through five with player station number one being left-most of a dealer stationed near the center of a straight edge of the table.

Five groups of indicia, correspondingly numbered one through five, are carried on a felt covering on the top of the table respectively adjacent to player stations one through five. In other words, the playing surface is the felt covering. Each of the groups is similar to the group described in connection with the preferred embodiment described hereinbefore.

A player makes first, second and third base wagers by placing wagering tokens within the indicia 11, 12, 13, respectively. When either a first, second or third base card is needed, it is obtained from a shoe that contains six standard decks of cards that are shuffled.

In the table game, the subject matter of the action schedules are checks-not their video images as described in the preferred embodiment. Additionally, the actions taken in accordance with the action schedules are taken by the dealer and a payout in accordance with the payout schedule is made by the dealer. In other words, during the play at the table, the player does not handle either cards or checks.

While the invention has been particularly shown and described with reference to a preferred embodiment thereof, it should be understood by those skilled in the art that changes in form and detail may be made therein without departing from the spirit and scope of the invention.

I claim:

1. A method of playing a game, comprising the steps of:

providing a playing surface that carries first base, second base and third base indicia and a home plate indicium disposed to form a miniature baseball diamond;

disposing a representation of a first base wager within said first base indicium;

displaying a first base card face-up on said playing surface;

taking a first base action in accordance with a first base action schedule after said displaying of said first base card;

displaying a second base card face-up upon said playing surface after said action in accordance with said first base schedule;

taking a second base action in accordance with a second base action schedule after said displaying of said second base card;

displaying a third base card face-up upon said playing surface after said action accordance with said second base action schedule;

taking a third base action in accordance with a third base action schedule after said displaying of said third base card; and making a payout to said player after the taking of said first, second and third base actions, said payout being a known multiple of an amount represented as being within said home plate indicium.

2. In the method of claim 1 including the additional step of disposing a representation of a second base wager within said second base indicium.

3. In the method of claim 2 including the additional step of disposing a representation of a third base wager within said third base indicium.

4. In the method of claim 3 wherein said second base wager is less than or equal to said first base wager and said third base wager is less than or equal to said second base wager.

5. In the method of claim 4 wherein said first base action schedule is given as:

FIRST BASE ACTION SCHEDULE

| FIRST BASE CARD | ACTION |
|---|---|
| 10, Jack, Queen or a King | removing said representation of said first base wager |
| Ace | advancing said representation of said first base wager to said home plate indicium |
| 5, 6, 7, 8 or 9 | advancing said representation of said first base wager advanced to said second base indicium |
| 4 of diamonds | advancing said representations of said first, second and third base indicia to said home plate indicium |
| 4 of spades, hearts or clubs | removing said representations of said first, second and third base wagers |
| 2 | advancing said representation of said first base wager to the third base indicium |
| 3 | advancing said representation of said first base wager to the home plate indicium. |

6. In the method of claim 5 wherein said second base action schedule is given as:

SECOND BASE ACTION SCHEDULE

| SECOND BASE CARD | ACTION |
|---|---|
| 10, Jack, Queen or a King | remove representations of wagers from said second base indicium |
| Ace | advance representations of wagers from said second base indicium to said home plate indicium |
| 5, 6, 7, 8 or a 9 | advance representations of wagers from said second base indicium to said third base indicium |
| 4 | remove representations of wagers from said second and third base indicia |
| 2, 3 | advance representations of wagers from said second base indicium to said home plate indicium. |

7. In the method of claim 6 wherein said third base action schedule is given as:

THIRD BASE ACTION SCHEDULE

| THIRD BASE CARD | ACTION |
|---|---|
| 4, 10, Jack, Queen or a King | remove representations of wagers from said third base indicium |
| Ace, 2, 3, 5, 6, 7, 8, or 9 | advance representations of wagers from said third base indicium to said home plate indicium. |

8. In the method of claim 7 wherein said payout schedule is given as:

PAYOUT SCHEDULE

| PAYOUT MULTIPLE | FIRST SECOND AND THIRD BASE CARDS |
|---|---|
| 3 | three card straight i.e. 3 of clubs, 4 of hearts and 5 of spades |
| 5 | three of a kind i.e. 5 of clubs, 5 of diamonds, 5 of spades |
| 10 | three card straight flush i.e. 3, 4 and 5 of clubs |
| 500 | three Aces of diamonds |
| | three 2's of diamonds |
| | three 3's of diamonds |
| | three 5's of diamonds |
| | three 6's of diamonds |
| | three 7's of diamonds |
| | three 8's of diamonds |
| 1000 | three 9's of diamonds |
| 1 | all other combinations of three cards |

9. In the method of claim 1 wherein said step of providing said playing surface includes providing a video screen of a video slot machine whereon said first, second and third base indicia and said home plate indicium are video images.

10. In the method of claim 9 wherein said first, second and third base action schedules are electronically stored by said slot machine and an action taken in connection therewith is a machine action.

11. In the method of claim 9 wherein said step of disposing includes the step of causing a video image of wagering tokens representative of said first base wager to appear within said first base indicium.

12. In the method of claim 11, including the additional step of causing a video image of wagering tokens representative of a second base wager to appear within said second base indicium.

13. In the method of claim 12, including the additional step of causing a video image of wagering tokens representative of a third base wager to appear within said third base indicium.

14. In the method of claim 1 wherein said step of providing said playing surface includes providing a covering for a table top.

15. In the method of claim 14 wherein said step of disposing includes placing wagering tokens within said first base indicium.

16. In the method of claim 15 including the additional step of placing wagering tokens representative of a second base wager within said second base indicium.

17. In the method of claim 16 including the additional step of placing wagering tokens representative of a third base wager within said third base indicium.

18. In the method of claim 1 wherein said playing surface additionally carries three similar rectangular indicia that are disposed adjacent to said first, second and third base indicia, respectively.

* * * * *